US005353762A

United States Patent [19]

Dykstra et al.

[11] Patent Number: 5,353,762

[45] Date of Patent: Oct. 11, 1994

[54] MODULAR AUTOMATIC SPEED CHANGING SYSTEM

[75] Inventors: Richard A. Dykstra, Cedar Grove; John A. Fiorenza, II, Slinger, both of Wis.

[73] Assignee: Briggs & Stratton Corporation, Wauwatosa, Wis.

[21] Appl. No.: 59,995

[22] Filed: May 10, 1993

[51] Int. Cl.[5] ..... F02D 31/00

[52] U.S. Cl. ..... 123/352; 123/339

[58] Field of Search ..... 123/352, 339, DIG. 6; 364/426.04; 417/34

[56] References Cited

U.S. PATENT DOCUMENTS

| | | | |
|---|---|---|---|
| 3,217,652 | 11/1965 | Olson | 103/17 |
| 3,276,439 | 10/1966 | Reichenbach | 123/98 |
| 4,139,332 | 2/1979 | Cantrell et al. | 417/34 |
| 4,307,690 | 12/1981 | Rau et al. | 123/353 |
| 4,425,888 | 1/1984 | Engel et al. | 123/339 |
| 4,471,735 | 9/1984 | Collonia | 123/339 |
| 4,531,489 | 7/1985 | Sturdy | 123/320 |
| 4,532,901 | 8/1985 | Sturdy | 123/333 |
| 4,549,400 | 10/1985 | King | 60/394 |
| 4,779,591 | 10/1988 | Tordenmain | 123/352 |
| 4,836,164 | 6/1989 | Morozumi et al. | 123/339 |
| 4,875,448 | 10/1989 | Dykstra | 123/352 |
| 4,955,344 | 9/1990 | Tatsumi et al. | 123/352 |
| 4,969,435 | 11/1992 | Morikawa et al. | 123/339 |
| 5,035,580 | 7/1991 | Simonette | 417/34 |
| 5,036,814 | 8/1991 | Osawa et al. | 123/352 |
| 5,080,062 | 1/1992 | Strenzke | 123/352 |
| 5,105,331 | 4/1992 | Dykstra et al. | 361/236 |
| 5,155,687 | 10/1992 | Katayama | 364/426.04 |
| 5,184,589 | 2/1993 | Nonaka | 123/352 |
| 5,186,142 | 2/1993 | Brunelli et al. | 123/339 |

OTHER PUBLICATIONS

Honda, "PA2010 Auto-Idle Kit, Installation and Operation Instructions", pp. 1-4, published Oct.,1992.

*Primary Examiner*—Raymond A. Nelli

*Attorney, Agent, or Firm*—Andrus, Sceales, Starke & Sawall

[57] ABSTRACT

The modular, automatic idle down system is plugged in series between the 120 VAC output connector of a generator and the input plug of the load device. One prong of the load's input plug may be received directly in a load sensor, such as a Hall effect sensor. The self-contained modular unit is connectable to the mechanical or electronic governor of the generator's engine. The idling system provides two time delays which delay the idling down of the engine upon initial starting and when the load is removed from the generator. When the sensed load current falls below a threshold value, the idling system generates an output signal, after the predetermined time delays, to override the engine's mechanical or electronic governor. The speed-of the engine is thereby reduced from the governed speed to an idle speed.

15 Claims, 2 Drawing Sheets

MODULAR AUTOMATIC SPEED CHANGING SYSTEM

BACKGROUND OF THE INVENTION

This invention relates to generators and similar devices used to power a load. More particularly, this invention relates to idling systems and speed governors for such devices.

Generators and similar devices are known for powering a load, such as a compressor, a power drill, a power hammer, or the like. Such generators typically include an internal combustion engine having a speed governor, and a control panel that includes an output receptacle-type connector. The generator outputs 120 VAC to the output connector. The load device typically has a complimentary male-type two or three prong plug that connects to the output connector on the generator control panel.

It is often desirable to reduce the running or governed speed of the generator to a lower idle speed when the load is not being used. This speed reduction lessens the amount of fuel that is used to operate the engine, reduces noise and vibration, and overall tends to lengthen the usable life of the generator and engine.

Many devices are known for reducing the idle speed of power-driven devices such as generators, automobiles, and the like. Some of these prior art devices override the speed governor to automatically reduce the governed speed to an idle speed when the load is not being used. However, a major shortcoming of prior art automatic idling systems is that if they are not built into the generator when the generator is manufactured, they may only be installed in the after-market by a qualified electrical serviceman at substantial time and expense.

To retrofit an automatic idling system or "auto-idle kit" onto an existing generator, the generator must be partially disassembled, and various wires, brackets, connectors and switches must be installed in the generator. This installation is not possible in the field, nor may it be performed by a non-technical person.

SUMMARY OF THE INVENTION

A modular, automatic speed changing system is disclosed for a load-powering device such as a generator. The speed changing system, which is preferably an automatic idling system used with an engine-powered governor, is modular in nature and is plugged in series between the output connector of the device's control panel and the input connector of the load. The modular speed changing system may be installed within seconds by any non-technical person in the field.

In a preferred embodiment, the modular speed-changing system includes a housing, a first input connector that is interconnected with the housing, and a first output connector that is also interconnected with the housing. The first input connector is preferably a standard, two or three prong 120 VAC plug that is detachably connected to a standard, 120 VAC output receptacle on the faceplate of the generator device.

The first output connector of the automatic speed changing system is preferably a standard, 120 VAC receptacle that is adapted to be detachably connected to a standard, 120 VAC two or three prong load input connector or plug.

The speed changing system also includes a means for sensing a parameter that is functionally related to the load, such as the current being drawn by the load or the speed of the device's engine. If the load current is sensed, the sensing means preferably includes a Hall effect sensor into which at least one prong of the load input connector plug is inserted. In the alternative, the sensing means may include a toroid coil.

The automatic speed changing system also includes a means for generating an output signal to the device that changes the speed of the device if the sensed parameter differs from a predetermined threshold value. If the sensed parameter is load current, the generating means will generate an output signal to reduce the device's governed speed to an idle speed when the load current falls below the threshold value. If the sensed parameter is the device's engine speed, the generating means will generate an output signal to reduce the device's speed if the engine speed is above a predetermined threshold value. In either event, it is desirable to delay the generating of the output signal for a predetermined time period upon the starting of the device to allow the device to reach its normal operating speed. It is also desirable to delay the generates of the output signal for a second predetermined time period after the sensing means senses that the sensed parameter differs from the threshold value to minimize unnecessary cycling between the normal operating speed and the engine speed when the load is being intermittently applied.

If the speed changing system is used with a device having a mechanical speed governor, the output signal from the generating means causes the solenoid of the mechanical governor to magnetically attract a governor arm and thereby override the governor. If the speed changing system is used with a device having an electronic governor, the output signal from the generating means disables the electronic governor.

It is a feature and advantage of the present invention to provide a self-contained modular automatic speed changing system that may be installed by any non-technical person in a matter of seconds.

It is yet another feature and advantage of the present invention to provide a modular, automatic idling system for generators.

It is yet another feature and advantage of the present invention to greatly reduce the cost and time in retrofitting an automatic idling system onto an existing generator.

These and other features and advantages of the present invention will be apparent to those skilled in the art from the following detailed description of the preferred embodiments and the drawings, in which:

BRIEF DESCRIPTION OF THE DRAWINGS

FIG. 6 depicts a preferred embodiment having a Hall effect sensor used in connection with a mechanical governor.

FIG. 7 depicts a circuit used in connection with the electronic governor.

FIG. 8 depicts a toroid coil used as a load sensor for a device having a mechanical governor.

DETAILED DESCRIPTION OF THE PREFERRED EMBODIMENT

Figure 1:
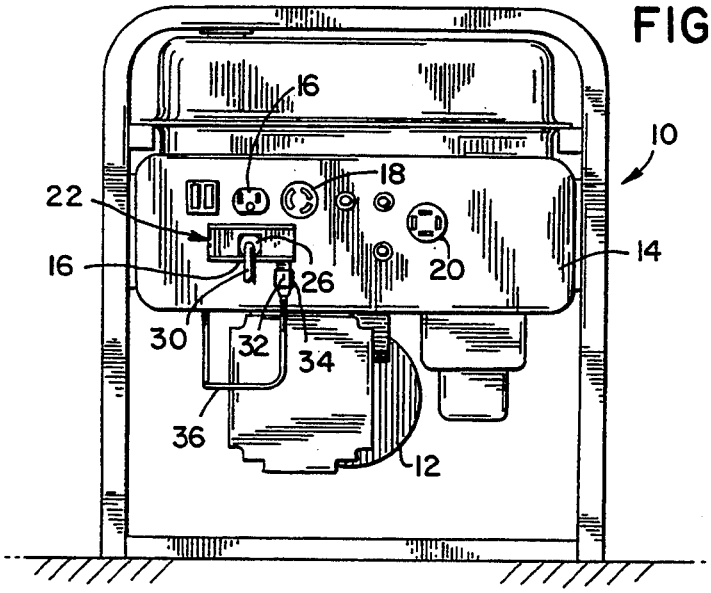
FIG. 1 is a front view of a generator into which has been plugged a speed changing system according to the present invention.

In FIG. 1, generator 10 is powered by an internal combustion engine 12, and includes a faceplate 14. Interconnected with faceplate 14 are a plurality of output, receptacle-type connectors 16, 18 and 20. Connectors 16 are three prong, 120 VAC output connectors. The modular, automatic idling system 22 has an input, male-type three-prong connector 24 (FIG. 3) that is detachably connected to generator output connector 16. A load device (not shown) has an input male-type connector 26 that is plugged into a receptacle-type three-prong connector 28 of modular speed changing system 22. Connected to plug 26 is a power cord 30 (FIG. 1) attached to the load device. The load device may be a compressor, a power drill, a power saw, or any other power-driven device that operates on the generator's power.

Figure 2:
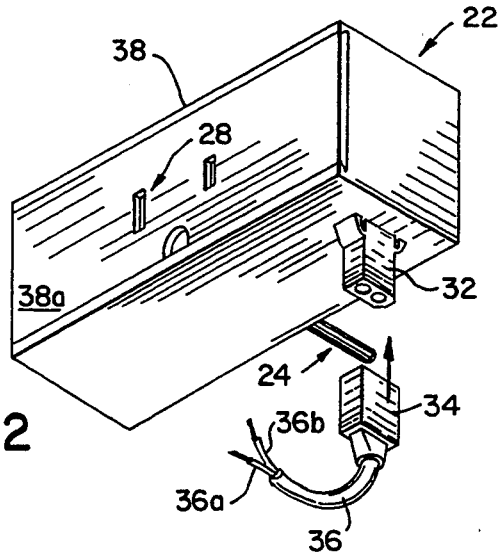
FIG. 2 is a front perspective view of the modular speed changing system according to the present invention.

Modular system 22 includes another output plug 32 (FIGS. 1 and 2) that is interconnected with a plug 34 attached to a lead 36 from engine 12. Lead 36 includes two wires **36*a* and 36*b* (FIG. 2). If engine 12 has a mechanical governor, lead 36 is preferably connected to a solenoid that attracts a governor arm of the mechanical governor to override the governor, as needed, to reduce the engine speed to an idle speed in response to an output signal from system 22. If engine 12 has an electronic governor, lead 36** is connected to the electronic governor control module to override the electronic governor when the load differs from a threshold value.

Figure 3:
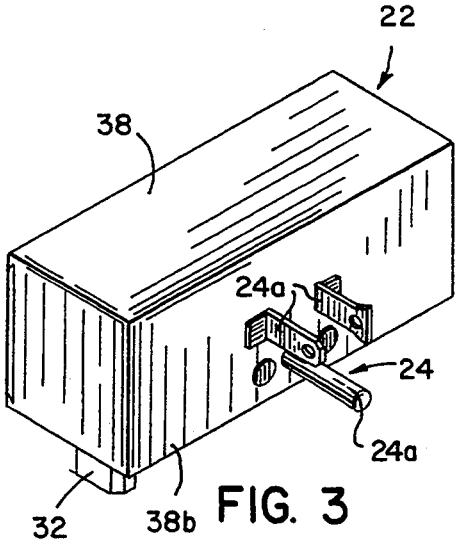
FIG. 3 is a back perspective view of the modular speed changing system according to the present invention.
Figure 4:
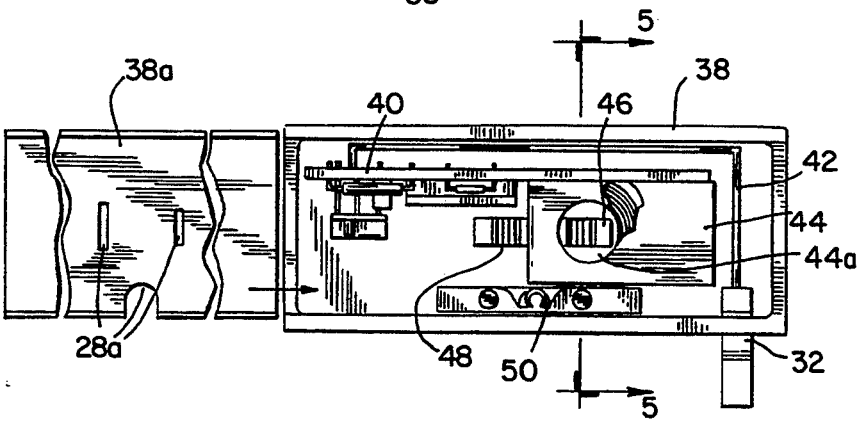
FIG. 4 is a front view of the speed changing system, with the front cover having been removed.

As best shown in FIGS. 2–4, modular speed changing system 22 is enclosed in a housing 38. A front plate **38*a* of housing 38 slidably engages the main part of housing 38 (FIG. 4) so that it may be removed. Of course, it may be desirable to permanently attach faceplate 38*a* to housing 38. Faceplate 38*a* includes slots 28*a* which form a portion of receptacle-type connector 28. Back plate 38*b* of housing 38 has interconnected therewith three prongs 24*a* of connector 24** (FIG. 3).

Figure 5:
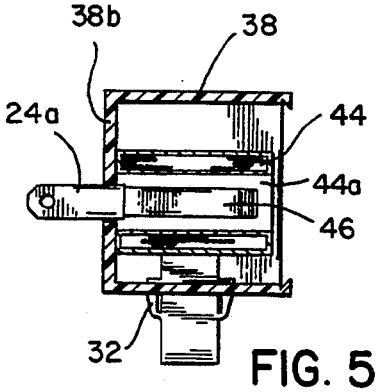
FIG. 5 is a side cross sectional view of a preferred load sensor, taken along line 5—5 of FIG. 4.

Referring to FIGS. 4 and 5, speed changing system 22 includes a circuit board 40 to which are mounted most of the circuit components. A wire 42 connects plug 32 to circuit board 40. A load sensor, such as Hall effect sensor 44, has an aperture **44*a* in which is disposed a prong receptacle 46 that is adapted to receive one of the prongs 36 of the load input connector. The other prongs of connector 26 are placed in receptacles 48 and 50. Hall effect sensor 44 senses a change in current that is being drawn by the load through the prong of plug 26 that is disposed within aperture 44*a* and in receptacle 46. When the load is not being applied, the load current is sensed by sensor 44 will drop below a threshold value, causing speed control system 22 to send an output signal via plug 32 and 34 in line 36** to the engine to reduce the engine speed from a governed speed to an idle speed. In general, the speed changing system could also be designed to change the speed—either up or down—when the load current is either above or below the threshold value without departing from the scope of the present invention.

In the alternative, Hall effect sensor 44 may be replaced by a toroid coil which would also sense the current being drawn by the load through load connector 26. In another alternate embodiment, the speed of engine 12 may be sensed in a manner that is well known in the art, and the speed signals could be used to determine whether the load is being applied. If the load is not being applied, the engine speed will typically rise above a threshold value. Thus, when the sensed speed rises above a predetermined threshold value, system 22 according to the present invention would output an output signal to reduce the engine speed to an idle speed.

Figure 7:
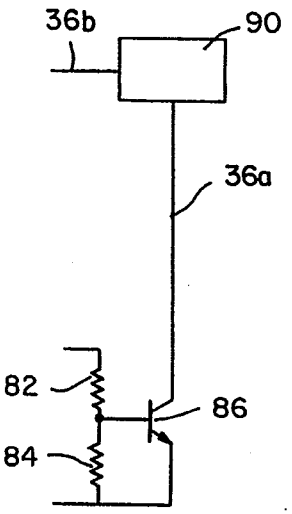
FIGS. 6 through 8 are schematic diagrams of several circuits that may be used in the speed changing system.
Figure 6:
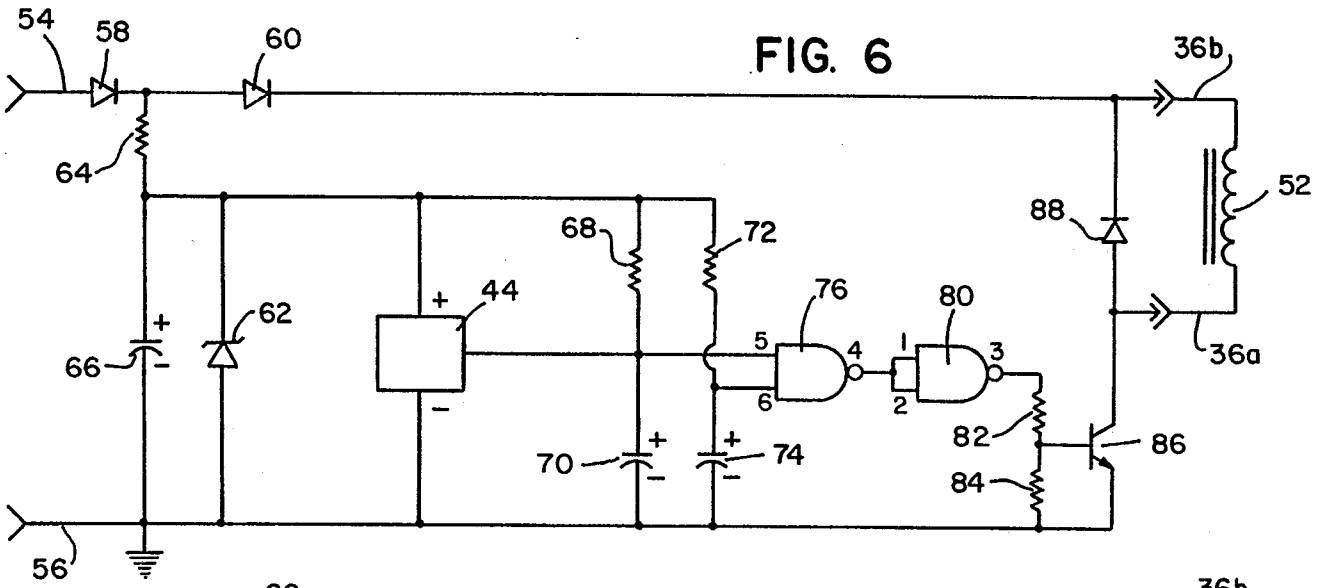
Figure 8:
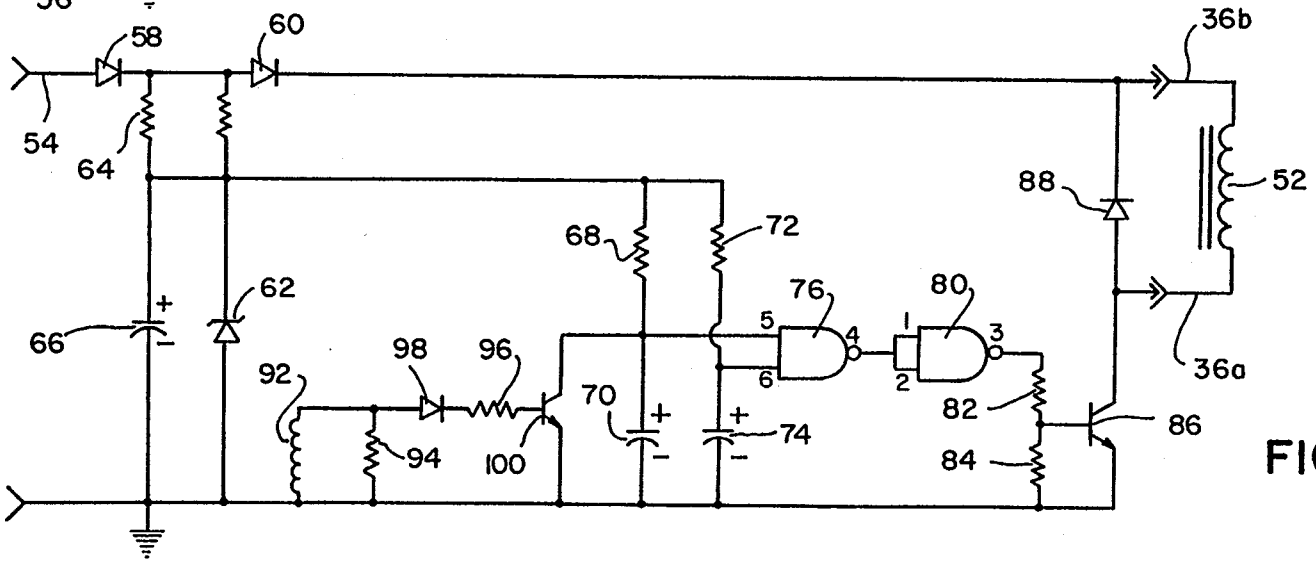

FIGS. 6 through 8 are schematic diagrams of the speed changing system according to the present invention. These Figures represent different embodiments of the present invention. In these Figures as in all the Figures, corresponding components have been given the same numerical designations.

FIG. 6 is a schematic diagram of a circuit having a Hall effect sensor 44 and that is used to operate on a mechanical governor via a solenoid 52. In FIG. 6, power is provided via lines 54 and 56, which are connected to prongs **24*a* (FIG. 3) of connector 24. Diodes 58, 60 and 62, along with resistor 64 and capacitor 66, provide filtering of the input signal. Small changes in the load current are sensed by load sensor 44**. The Hall effect load sensor is preferably either a part number CSDA1AA or CSDA1BA Hall effect sensor available from the Microswitch Division of Honeywell.

The RC timing network consisting of resistor 68 and capacitor 70 provides an 8 to 10 second delay between the time that the load is removed from the generator and the time that the output of load sensor 44 goes high. A second RC timing network, consisting of resistor 72 and capacitor 74, provides a 30 to 40 second delay between the time that engine 12 (FIG. 1) is started and the time that the output of load sensor 44 goes high to allow the engine to warm up before the speed changing system begins its operation. This feature allows the engine to warm up at the governed speed if no load is applied during starting, to prevent stalling in cold weather.

NAND gates 76 and 80 are two NAND gates interconnected with the output of load sensor 44. NAND gates 76 and 80 are two NAND gates that are present on a Quad NAND Schmitt trigger integrated circuit, with the other two NAND gates not being used. This integrated circuit is preferably a chip currently available from Motorola.

The output of NAND gate 80 is connected to a voltage divider consisting of resistors 82 and 84, which in turn is connected to the gate of a high gain power Darlington transistor 86. Although a silicon-controlled-rectifier (SCR) may be used in place of Darlington 26, the high gain power Darlington is preferred to prevent electrical noise from switching on the semiconductor switch. A diode 88 protects switch 86 from transient voltages.

FIG. 7 depicts a modification to the circuit in FIG. 6 that is used if engine 12 (FIG. 1) has an electronic governor. In that case, the output signal from transistor 86 is provided on line **36*a* to electronic governor 90. Solenoid 52** (FIGS. 6 and 7) is not used.

The circuit depicted in FIG. 8 is substantially the same as the circuit depicted in FIG. 6 except that a different method is used to sense the load being applied to the generator device. In FIG. 8, the load sensor includes a toroid coil 92, resistors 94 and 96, diode 98 and transistor switch 100.

In any of the embodiments described herein, whether the load is being applied may be determined by fluctuations in the currents of a coil of the generator itself instead of by determining the fluctuations in the load. In that case, either one or both of the generator coils would be passed through Hall effect sensor 44 (FIG. 6), or would be placed in proximity to toroid coil 92 (FIG. 8). It may be necessary to reduce the solenoid current or the sensitivity of toroid 92 to make sure that the current through toroid 92 does not adversely effect system performance.

The operation of the speed changing system will now be described. Referring to FIG. 6, when engine 12 is first started, the time delay provided by resistor 72 and capacitor 74 holds pin 6 of NAND gate 76 low for a period of 30 to 40 or more seconds after the engine is initially started. The holding of pin 6 low makes the output at pin 4 go high, so that the input at pins 1 and 2 of NAND gate 80 are also high. The output of NAND gate 80 thus goes low, keeping Darlington transistor 86 off and preventing solenoid 52 from being energized.

After this time delay has elapsed, pin 6 of NAND gate 76 goes high, so that only the output of sensor 44 to pin 5 of NAND gate 76 determines whether or not solenoid 52 is energized.

When load sensor 44 senses a load current that is above a predetermined threshold level, the output of load sensor 44 goes low, so that pin 5 is also low. Whenever pin 5 of NAND gate 76 is low, the output of NAND gate 76 goes high, so that the output of NAND gate 80 goes low and switch 86 remains off.

When load sensor 44 determines that the load has been removed, the output of load sensor 44 goes high after a predetermined time period, set by the time constant of resistor 68 and capacitor 70. After this time period has elapsed, the output signal from load sensor 44 goes high, so that pin 5 of NAND gate 76 also goes high. Thus, both pins 5 and 6 of NAND gate 76 are high so that pin 4 of NAND gate 76 goes low, as do pins 1 and 2 of NAND gate 80. The output at pin 3 of NAND gate 80 thus goes high, thereby switching on Darlington transistor 86 and energizing solenoid coil 52. When solenoid coil 52 is energized, it magnetically attracts a lever or governor arm or the mechanical governor, thereby overriding the governor of engine 12 (FIG. 1).

The speed of the generator device is thus reduced from its governed speed to a lower, idle speed as long as load sensor 44 continues to sense that the load is not being applied to the generator device.

The circuit depicted in FIG. 8 operates in a similar manner. In FIG. 8, the removal of the load is sensed by toroid coil 92, which outputs the signal to turn on transistor 100. Pin 5 of NAND gate 76 goes high, but only after the time delay periods, resulting from either or both of the RC networks, have elapsed.

The speed changing system according to the present invention may also include a bracket to hold solenoid 52 and a bracket to hold the throttle arm. Bothof these brackets may be designed to bolt on or to clamp on with minimal effort.

While several preferred embodiments of the present invention have been shown and described, alternate embodiments will be apparent to those skilled in the art and are within the intended scope of the present invention. Therefore, the invention is to be limited only by the following claims.

We claim:

1. An automatic speed changing system for a device that powers a load, said device having a device output connector, and said load having a load input connector that is detachably connectable to said device output connector, said speed changing system comprising:

a housing;

a first input connector, interconnected with said housing, that is detachably connectable to said device output connector;

a first output connector, interconnected with said housing, that is detachably connectable to said load input connector;

means for sensing a parameter functionally related to said load; and means for generating an output signal to said device to change the speed of said device if said sensed parameter differs from a threshold value.

2. The system of claim 1, wherein said sensing means is disposed within said housing.

3. The system of claim 1, wherein said parameter sensed by said sensing means is the current drawn by said load.

4. The system of claim 3, wherein said sensing means includes a coil.

5. The system of claim 3, wherein said sensing means includes a Hall effect sensor.

6. The system of claim 1, wherein said sensing means is adapted to receive therein at least part of said load input connector.

7. The system of claim 1, wherein said parameter is the speed of said device.

8. The system of claim 1, wherein said first input connector is a standard 120 VAC plug having at least 2 prongs.

9. The system of claim 1, wherein said first output connector is a standard, 120 VAC receptacle.

10. The system of claim 1, wherein said generating means includes a second output connector that interconnects said speed changing system to a speed governor of said device.

11. The system of claim 10, wherein said second output connector interconnects said speed changing system with a solenoid of a mechanical speed governor.

12. The system of claim 10, wherein said second output connector interconnects said system with an electronic speed governor.

13. The system of claim 1, wherein said output signal causes the speed of said device to change from a running speed to an idle speed.

14. The system of claim 1, wherein said generating means generates said output signal only after a predetermined time period has elapsed since said device has been started.

15. The system of claim 1, wherein said generating means generates said output signal only if a predetermined time period has elapsed since the time that said sensed parameter differs from said threshold value.

* * * * *